United States Patent [19]

Young

[11] Patent Number: 4,787,440

[45] Date of Patent: Nov. 29, 1988

[54] SPIRAL FLOW IN A SHELL AND TUBE HEAT EXCHANGER

[75] Inventor: Richard K. Young, Bartlesville, Okla.

[73] Assignee: Phillips Petroleum Company, Bartlesville, Okla.

[21] Appl. No.: 88,747

[22] Filed: Aug. 24, 1987

Related U.S. Application Data

[62] Division of Ser. No. 326,777, Dec. 2, 1981, Pat. No. 4,697,637.

[51] Int. Cl.[4] ..... F28D 7/00; F28F 9/00; F28F 9/22

[52] U.S. Cl. ..... 165/1; 165/159; 165/160; 165/162

[58] Field of Search ..... 165/109.1, 159, 160, 165/161, 162; 122/510

[56] References Cited

U.S. PATENT DOCUMENTS

| | | | |
|---|---|---|---|
| 1,882,474 | 10/1932 | Black . | |
| 1,929,376 | 10/1933 | Trainer et al. . | |
| 1,946,234 | 2/1934 | Price . | |
| 1,987,051 | 1/1935 | Cattanach . | |
| 2,018,037 | 10/1935 | Sieder | 165/159 |
| 2,036,957 | 11/1936 | Price . | |
| 2,059,967 | 11/1936 | Leach . | |
| 2,229,344 | 1/1941 | Schneider . | |
| 2,384,714 | 9/1945 | Villiger | 165/161 |
| 2,402,881 | 6/1946 | Fausek et al. . | |
| 2,655,346 | 10/1953 | Corbitt et al. . | |
| 2,693,942 | 11/1954 | Guala | 165/161 |
| 2,830,797 | 4/1958 | Garland . | |
| 3,055,721 | 9/1962 | Holt . | |
| 3,228,456 | 1/1966 | Brown et al. . | |
| 3,277,959 | 10/1966 | Withers . | |
| 3,292,691 | 12/1966 | Welter et al. | 165/162 |
| 3,420,297 | 1/1969 | Romanos | 165/162 |
| 3,575,236 | 4/1971 | Romanos | 122/510 |
| 3,708,142 | 1/1973 | Small | 165/162 |
| 3,820,594 | 6/1974 | Ritland et al. . | |
| 3,907,031 | 9/1975 | Tegethoff | 122/510 |
| 3,937,277 | 2/1976 | Krolmann . | |
| 3,941,188 | 3/1976 | Scheidl | 165/162 |
| 3,964,146 | 6/1976 | Vestre et al. | 165/162 |
| 3,967,677 | 7/1976 | Mohlman | 165/162 |
| 4,021,204 | 5/1977 | Straffi . | |
| 4,036,461 | 7/1977 | Soligno . | |
| 4,127,165 | 11/1978 | Small | 165/162 |
| 4,136,736 | 1/1979 | Small | 165/162 |
| 4,286,366 | 9/1981 | Vinyard | 165/162 |
| 4,289,198 | 9/1981 | Young | 165/159 |
| 4,299,276 | 11/1981 | Small | 165/162 |
| 4,311,187 | 1/1982 | Small | 165/109.1 |
| 4,342,360 | 8/1982 | Gentry et al. | 165/162 |

FOREIGN PATENT DOCUMENTS

| | | |
|---|---|---|
| 570115 | 6/1945 | United Kingdom . |
| 685848 | 1/1953 | United Kingdom . |

OTHER PUBLICATIONS

Small et al., "Exchanger Design Cuts Tube Vibration Failures", Oil & Gas Journal, reprint from Sep. 5, 1977 edition.

*Primary Examiner*—Albert W. Davis, Jr.
*Assistant Examiner*—John K. Ford
*Attorney, Agent, or Firm*—Williams, Phillips & Umphlett

[57] ABSTRACT

Rod type supports or baffles are disclosed for arrays of tubes, especially those arranged in the form of a tube bundle. Each baffle comprises a pair of arcuate surfaces with a plurality of rods extending therebetween and each rod being non-normally disposed with respect to the axis of a tube bundle. In a preferred embodiment, a plurality of baffles are employed in a tube bundle so as to cause shell side fluid to sweep across the tubes in a spiral pattern, such as a double helical pattern. The invention provides an improvement in the mixing of shell side fluid in a rod baffle heat exchanger.

7 Claims, 4 Drawing Sheets

SPIRAL FLOW IN A SHELL AND TUBE HEAT EXCHANGER

This application is a division of application Ser. No. 326,777, filed Dec. 2, 1981 now U.S. Pat. No. 4,697,637 issued Oct. 6, 1987.

BACKGROUND OF THE INVENTION

The invention relates to a rod baffle. In another aspect the invention relates to tube bundles. In yet another aspect, the invention relates to heat exchangers, and to a method and apparatus to radially support the tubes in such heat exchangers and to improve shell side fluid flow distribution.

Heat transfer is an important part of any process. As is well known, an indirect transfer of heat from one medium to another is usually accomplished by the use of heat exchangers of which there are many types. For example, there are double pipe, shell and tube, plate heat exchangers and others. Indeed, the art of heat exchanger design has developed to a very high degree; however, there is still room for improvement in a number of areas. For example, in shell and tube heat exchangers, improving tube support, and also improving the flow pattern of shell side fluids.

Plate type baffles have been used in shell and tube heat exchangers for many years. Such baffles provide support for the tubes at least to some degree. The double segmental plate-baffle heat exchanger is well known to those skilled in the art, and although heat exchangers using plate type baffles were a relatively early development in heat exchanger design, such exchangers are still widely used today. In most plate baffled heat exchangers the passages in the plates through which the tubes pass are slightly larger in diameter than the outside diameter of the tubes in order to facilitate construction of the exchanger. As a result vibration of the tubes can and does occur which frequently results in premature tube failure. Also, exchangers utilizing plate baffles suffer from relatively stagnant volumes in the flow of shell side fluid immediately downstream of each baffle, in the sheltered area. Heat transfer is adversely affected. Further, especially where heat exchangers having plate-baffles are utilized for steam generation, localized overheating and vaporization can occur in the stagnant regions, causing scale formation and loss of heat transfer efficiency. Further, scale deposition or crevice corrosion can occur between the baffle and the tube which can lead to tube failure in the bundle.

U.S. Pat. No. 2,693,942, issued to J. R. Guala on Nov. 9, 1954, describes a heat exchanger utilizing plate-baffles arranged so as to provide a helical flow pattern of shell side fluid. A disadvantage of the apparatus disclosed by Guala is that it is extremely difficult to construct. Each baffle comprises two criss cross plates, with each plate being in the form of a segment of an elipse and pierced to permit passage therethrough of the tubes of the bundle. Construction of such a bundle would clearly be quite difficult.

OBJECTS OF THE INVENTION

It is an object of this invention to provide a baffle for a tube bundle which is simple and easy to construct.

It is another object of this invention to provide a baffle set for a tube bundle for causing spiral flow of shell side fluid through the bundle when it is employed in a heat exchanger.

It is a further object of this invention to provide a baffle system for a heat exchanger which improves mixing of shell side fluid to create a more uniform temperature at corresponding positions in the bundle.

Other advantages of this invention will be apparent from the drawings, detailed description of the invention and appended claims.

SUMMARY OF THE INVENTION

According to one aspect of the invention, an apparatus comprises a pair of arcuate surfaces positioned symmetrically with respect to an axis and lying in separate planes generally parallel to the axis and a plurality of rods positioned with their midpoints on the axis and lying in separate generally parallel planes, a first end of each rod affixed to a first of the pair of arcuate surfaces and a second end of each rod affixed to a second of the pair of arcuate surfaces.

According to another aspect of the invention, an apparatus comprises of plurality of tubes forming a tube bundle suitable for use in a shell and tube heat exchanger, the tubes positioned to form at least a first plurality of parallel tube rows and a second plurality of parallel tube rows with lanes between at least a portion of the adjacent tube rows; and at least one baffle set cooperating with the tube bundle to cause longitudinally spiralling flow of shell side fluid through the tube bundle; wherein each baffle of the set comprises at least one outer ring surrounding the tube bundle and having a pair of ends defining a first generally annular surface and a second generally annular surface, the first and the second generally annular surfaces lying in generally parallel planes longitudinally spaced apart along the longitudinal axis of the tube bundle and a plurality of rods each having a first end and a second end and positioned in at least a portion of the lanes between adjacent tube rows in one plurality of parallel tube rows, each of the rods attached by its first end to one of the generally annular surfaces and by its other end to the other of the generally annular surfaces.

In another aspect, the present invention provides a method for improving the capability of the tube bundle for mixing shell side fluid when the tube bundle is to be employed in a shell and the tube heat exchanger which utilizes generally longitudinal flow of shell side fluid. The method comprises providing the tube bundle with a plurality of encircling rings spaced apart longitudinally along the tube bundle and dividing the tube bundle into portions, and extending a plurality of rods transversely through each portion of the tube bundle, there being a plurality of rods in each portion of the tube bundle. Each of said rods of each such rod plurality has a first end affixed to a first end of a first ring and a second end affixed to a second end a different ring, the portion of the tube bundle between the first end of the first ring and the second end of the different ring being defined so that shell side fluid flows through the tube bundle in a longitudinally spiralling flow.

A BRIEF DESCRIPTION OF THE DRAWING

DETAILED DESCRIPTION OF THE INVENTION

Figures 9, 10, 11, 12, 13:
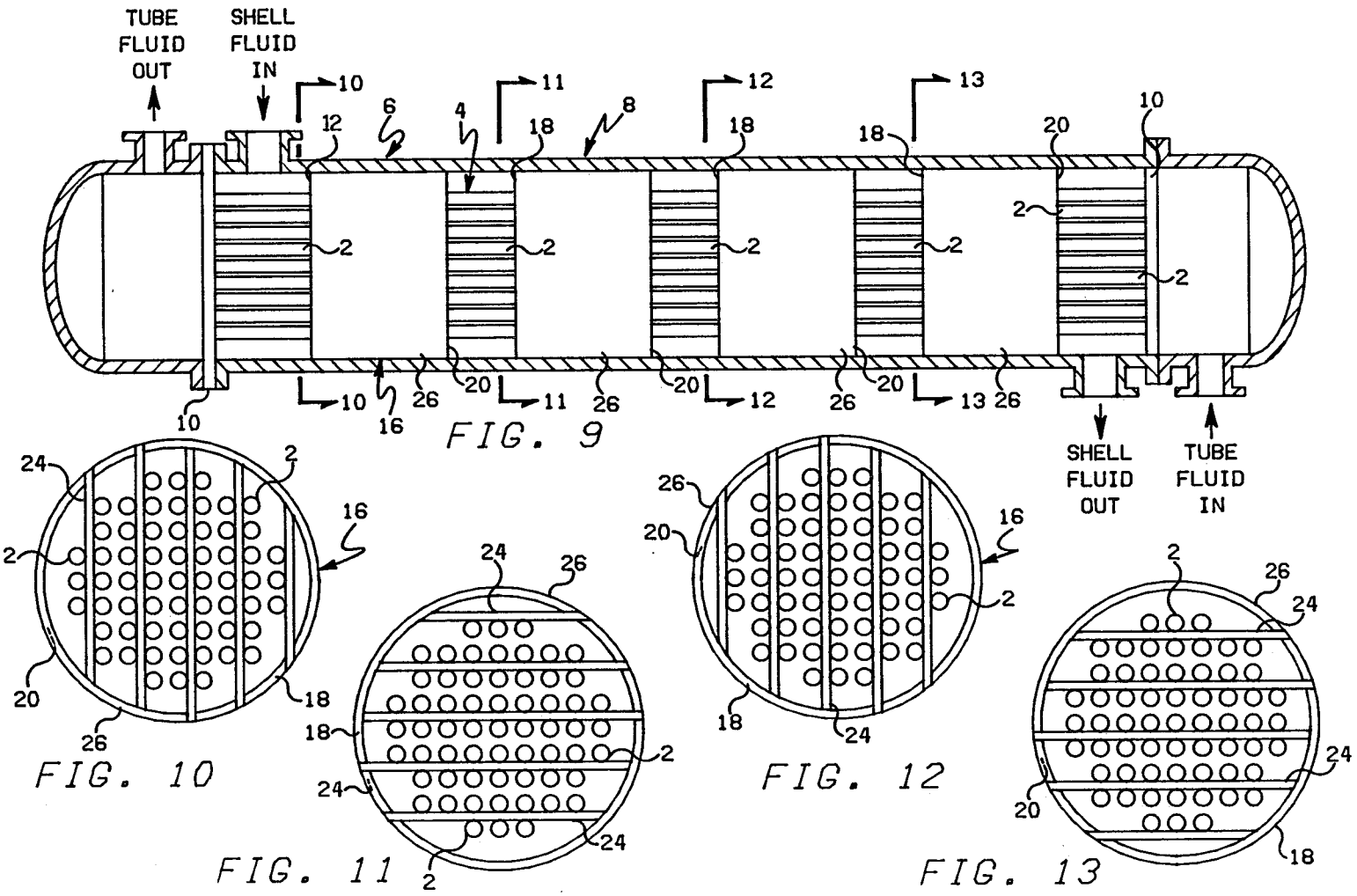
FIG. 9 is a pictorial representation of a tube bundle illustrating certain features of one embodiment of the present invention.
FIGS. 10–13 are cross-sectional views of the apparatus of FIG. 9 taken along the indicated lines.
Figure 14:
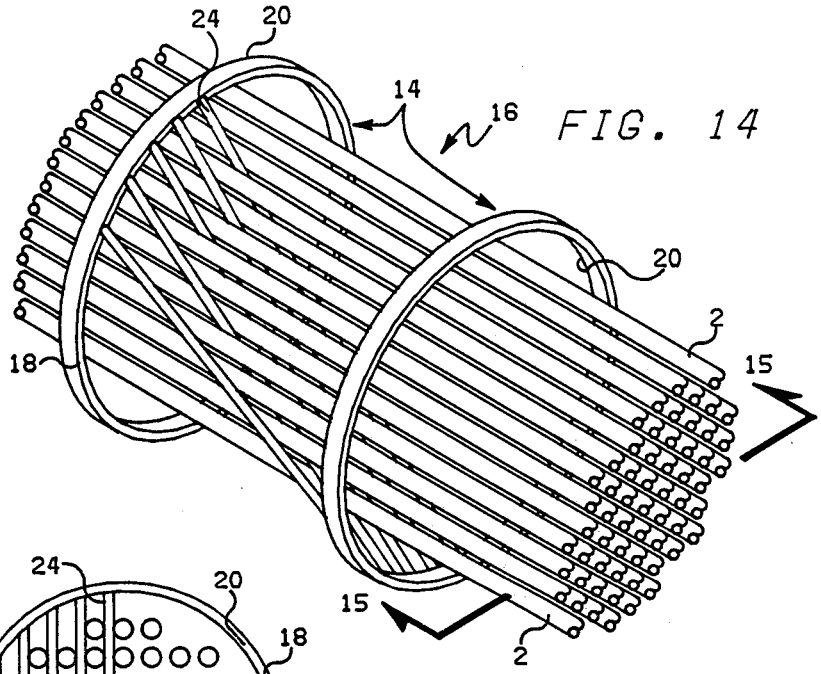
FIGS. 14 and 16 illustrate in isometric view certain features of an embodiment of the invention as deployed in portions of a tube bundle.

In accordance with one aspect of the present invention as best shown by FIG. 9, an apparatus comprises a plurality of tubes 2 forming a tube bundle 4 suitable for positioning in a shell 6 of the shell and tube heat exchanger 8. The tubes 2 are positioned to form at least a first plurality of parallel tube rows and a second plurality of parallel tube rows, with lanes between at least a portion of the adjacent tube rows. The preferred layout of the tube bundle is square pitch, as is best seen in the cross-sectional views shown by FIGS. 2, 4, 6, 8 and 10 through 13. Usually, the tube bundle will be provided with a means 10 such as tube sheets for supporting the ends of the tube bundle in the heat exchanger shell. If desired however, the invention can also be utilized with a U-tube type bundle in which instance one of the means 10 would comprise a plurality of U-shaped tube portions connecting half of the tubes of the bundle with the other half. It is expected, however, that best results will be obtained where each end of the tube bundle is supported by a tube sheet.

For ease of construction, it is preferred that the tube bundle 4 comprise an array of tubes 2 laid out on square pitch as illustrated. However, if desired, the tubes 2 could be laid out on a triangular pitch or, any other pitch, so long as lanes are provided between at least a portion of adjacent tube rows.

The bundle 4 is provided with a means 12 spaced apart longitudinally along the tube bundle for causing generally spiralling flow of shell side fluid through the bundle. According to the invention, the means 12 for causing spiralling flow of shell side fluid through the bundle comprises a set 14 of rod-baffles 16 (see FIG. 1, for example). Generally speaking, a baffle set 14 comprises a sufficient number of baffles to cause a spiral in the flow pattern of the shell side fluid around the longitudinal axis of the bundle. For example, one such baffle set is shown in FIGS. 1–8, while another is shown by FIGS. 9–13. FIGS. 14–17 show one half of a baffle set. It will be appreciated however, that the illustrated tube bundles are preferred embodiments only. Where the tubes of the bundle are laid out on a triangular pitch for example, a baffle set containing only three rod baffles would be necessary to cause a spiral in the flow of shell side fluid.

It is further preferred that the set of rod baffles provide radial support for each tube in the bundle at least one. That is, each baffle set contains a sufficient number of rods to place at least one rod through each lane through the tube bundle. It will be further appreciated that the number of baffles required to provide each tube with radial support is not necessarily the same number as required to cause a spiral in of flow pattern of shell side fluid longitudinally traversing the heat exchanger. For example, in the embodiment of the invention as shown by FIGS. 10–13, rods could be positioned in each lane between adjacent tube rows, and each tube in the tube bundle would be radially supported twice by a single baffle set.

Figure 1:
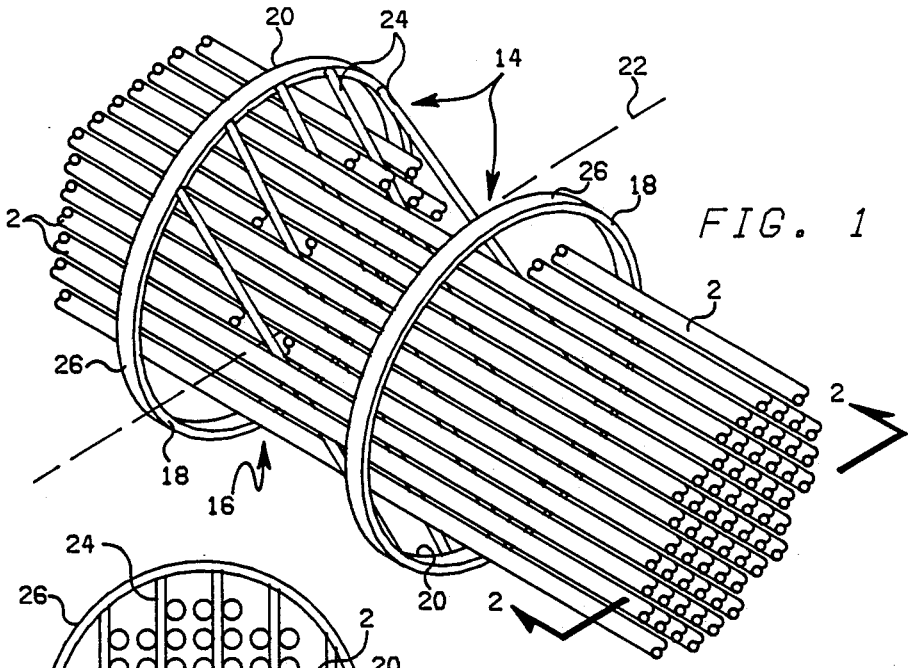
FIGS. 1, 3, 5 and 7 illustrate in isometric view certain features of an embodiment of the invention as deployed in portions of a tube bundle having portions thereof broken away.
Figure 2:
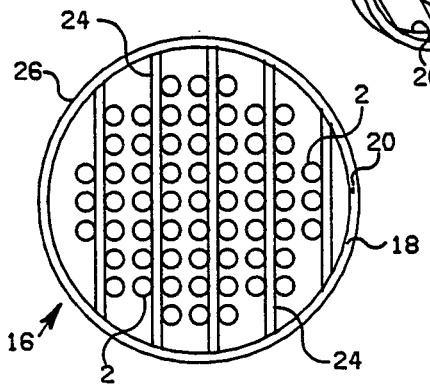
FIGS. 2, 4, 6 and 8 are cross-sectional views of FIGS. 1, 3, 5 and 7 respectively, taken along the indicated lines.
Figure 4:
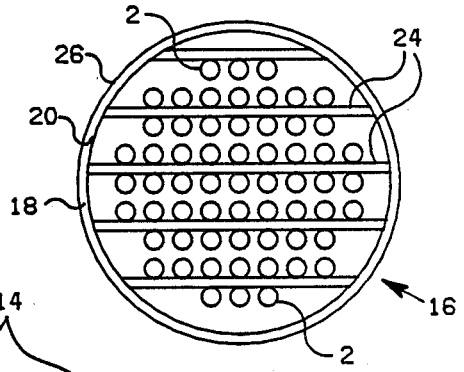
Figure 3:
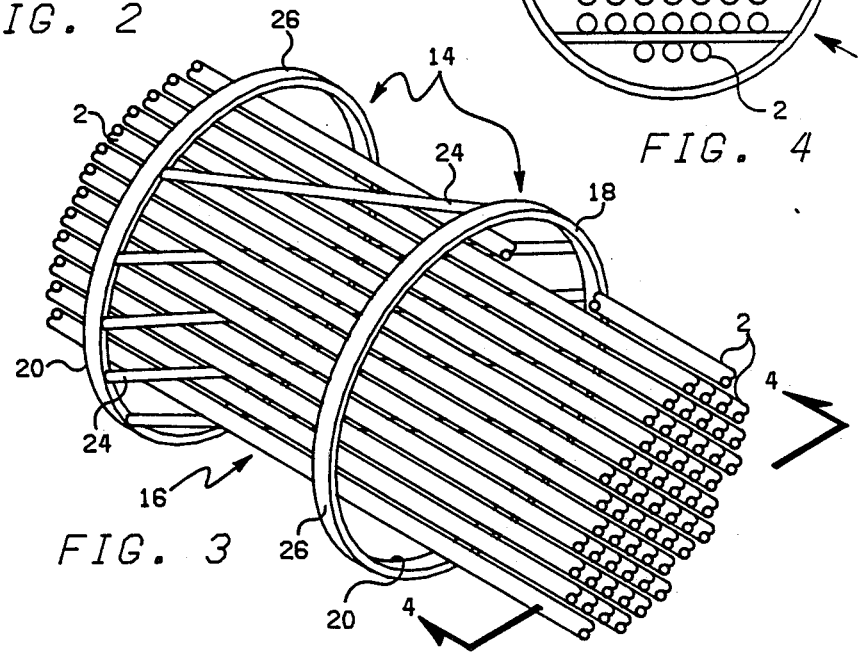
Figure 5:
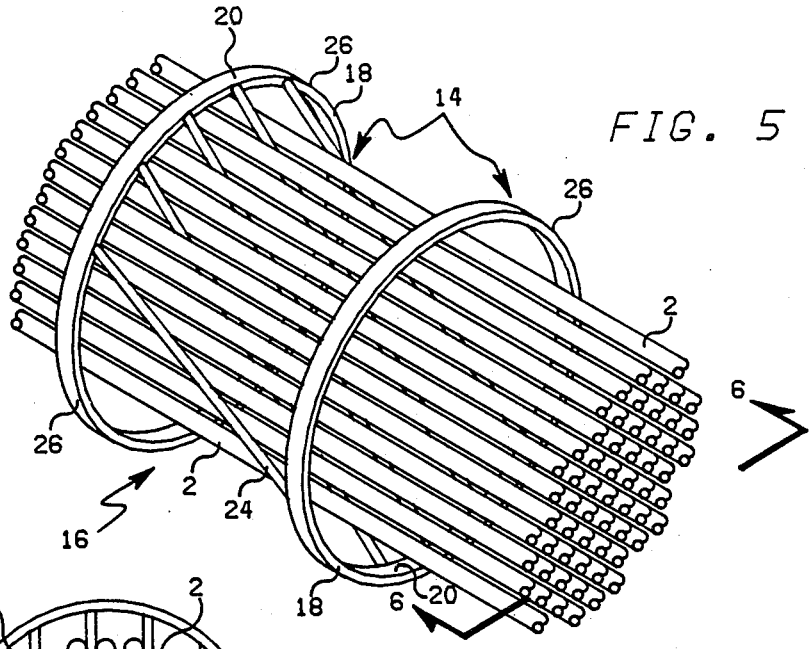
Figure 6:
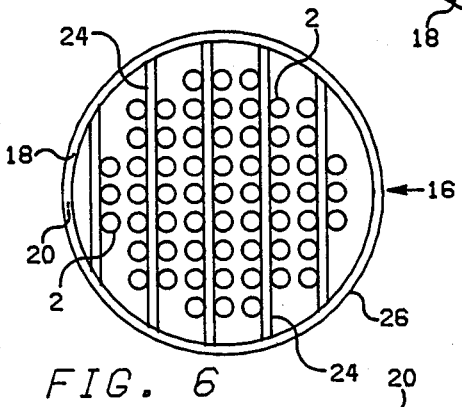
Figure 8:
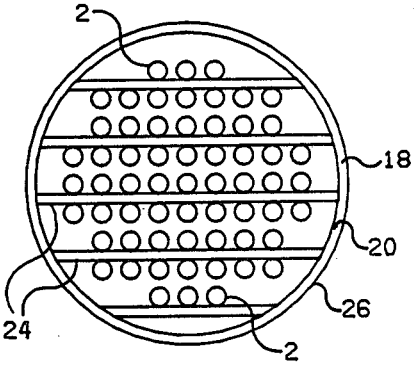
Figure 7:
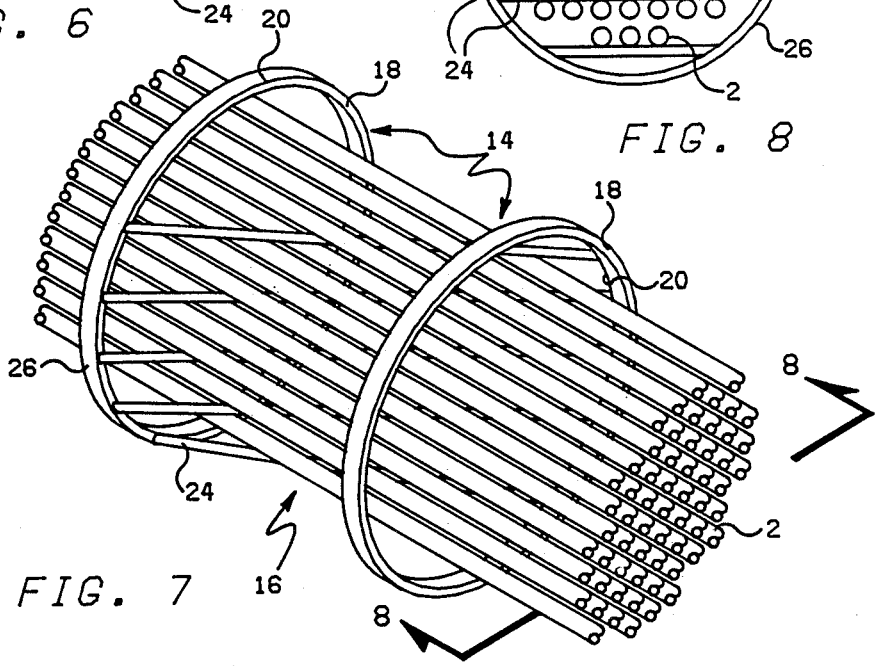

According to certain aspects of the invention, comprises a pair of arcuate surfaces 18 and 20 positioned symmetrically with respect to an axis 22 as shown by FIG. 1 which crosses preferably normally through the tube bundle and lies in separate plane generally parallel to the axis 22; and a plurality of rods 24 positioned with the midpoint of each rod on the axis and each rod of the plurality positioned in separate generally parallel planes, a first end of each rod affixed to a first of the arcuate surfaces and a second end of each rod affixed to a second of the arcuate surfaces.

The rods utilized in the present invention are generally elongated and can have any desired shape. For example, rods or bars can conveniently be utilized. Rods (circular cross-section) are preferred because of ready availability, a more streamlined cross section, and the capability of generating vortex streets especially when oriented approximately normally to the direction of shell side fluid flow. For heat exchange purposes, rods are thus preferred. For best results, each rod should have a width, preferably a diameter, which is equal to the spacing between the tube rows less the diameter of a tube, i.e. the width of a lane between two tube rows. By utilizing such a feature, a tube bundle having good resistance to vibration induced damage and good heat transfer capabilities can be easily constructed. In the embodiments illustrated, the arcuate surfaces 18 and 20 to which the ends of the rods 24 are affixed are portions of generally annular surfaces which encircle the tube bundle. Most preferably, each generally annular surface is defined by an end of a tubular member 26. In the embodiments of the invention shown in FIGS. 1–8, the tubular member 26 has a longitudinal dimension which is small, for example, less than 10% with respect to its diameter, and can aptly be described as a ring. In the embodiments of the invention shown in FIGS. 9–13, the tubular member 26 has a substantial longitudinal dimension, for example, a length greater than about 10% of its diameter and can best be described as a band. The annular surfaces to which the rods 24 are affixed can be different ends of the same tubular member (see FIGS. 9–13), or ends of different tubular members as desired. In the embodiments of the invention illustrated by the FIGURES the ends of the rods of a single plurality of rods are affixed to a pair of generally arcuate, annular surfaces which face in opposite directions. If desired, the rods can be affixed to arcuate surfaces which faces in the same direction.

Preferably, according to the invention, the annular surfaces to which the rods are affixed are positioned in planes which are substantially perpendicular to the longitudinal axis of the tube bundle. This is an important feature of the preferred embodiment of the present invention because of ease of construction. Essentially circular rings can be employed. Prior art apparatus having obliquely arranged elements employed elliptical shapes, which were extremely difficult to construct to close tolerances, especially when temperature expansion and contraction were allowed for. When generally circular rings or bands encircle the tube bundle and the ends of the rings or bands lie in planes which are substantially perpendicular to the axis to the tube bundle, it is a simple matter to construct baffles according to the invention to close tolerances. Preferably, and as illustrated, the rods 24 lie in generally parallel planes which are substantially evenly spaced apart to correspond to the lanes through the tube bundle. It will be appreciated however, that the rods do not all lie in the same plane. In this manner, each baffle of the set can be substantially identical to the other baffles, differing only in its orientation by rotation with respect to the axis of the bundle. It is important to note in accordance with this feature of the present invention, especially as illustrated by FIGS. 9–13, that a four step spiral is formed with at least four baffles being required to form the spiral, where the tubes have been laid out on a square pitch.

In the embodiment of the invention shown by FIGS. 1–8, each arcuate portion of the annular surface to which rods are attached has a span of between about 120 and 175 degrees. The pair of arcuate portions are separated, as measured center to center with respect to the longitudinal axis of the tube bundle by an angle of about 180°. In the embodiments of the invention as shown by FIGS. 9–13, each arcuate portion of the annular surface at the end of each tubular member to which rods are affixed has a span of between about 60° and 85°. Here also, the a pair of arcuate portions are separated, as measured center to center with respect to the longitudinal axis of the tub bundle by an angle of about 180°.

Generally speaking, the baffle set for causing longitudinally spiralling flow of shell side fluid through the tube bundle will comprise a plurality of baffles, usually at least 3. For ease of construction, the tube bundle is laid out on square pitch, and each baffle of a baffle set is substantially identical, differing by only its rotation about the axis of the tube bundle. Preferably, where the tube bundle is laid out on square pitch, each baffle set comprises a first baffle, a second baffle, a third baffle, and a fourth baffle serially arranged. These features of the invention are shown in FIGS. 2, 4, 6, 8, 10–13, and suggested by FIGS. 15 and 17. As shown by the FIGURES the baffles are spaced apart along the longitudinal axis of the tube bundle and the second baffle is oriented at a 90° angle of rotation about the longitudinal axis of the tube bundle with respect to the first baffle, (e.g. compare FIG. 4 to FIG. 2), the third baffle is oriented at a 90° angle of rotation from the second baffle and at a 180° angle of rotation from the first baffle, (e.g. compare FIG. 6 to FIG. 4 and 2), and the fourth baffle is oriented at a 90° angle of rotation from the third baffle and at a 180° angle of rotation from the second baffle, (e.g. compare FIG. 8 to FIGS. 6 and 4).

As previously mentioned, it is preferred that each baffle set provide radial support at least once for each tube of the bundle. It is further preferred that a tube bundle constructed in accordance with the present invention be supported by a plurality of baffle sets. Where the tube bundle is to be employed for gas service, rings or bands 26 should be spaced apart longitudinally with respect to the bundle axis at a spacing of between about 6 to 12 inches (0.15–0.31 m), center to center. Where the tube bundle is to be employed for liquid service, a baffle spacing of between about 10 and 18 inches (0.25–0.45 m) is preferred. As measured with respect to a plane normal to the longitudinal axis of the tube bundle, the rods when positioned according to the present invention will typically form angles between about 10° and 60° with respect to the plane.

From the embodiments of the invention shown by FIGS. 1–8, adjacent baffles could be slid together along the axis of the tube bundle so that each ring 26 of a baffle contacts the next adjacent ring 26 of the adjacent baffle. Where this close of a baffle spacing is desired, it can be advantageous to affix rods 24 to both ends of each ring 26 with the rods having a component extending in upstream and downstream directions with respect to the ring. Thus, when utilizing this aspect of the invention, a baffle set of 4 baffles could be formed from 5 rings rather than 8 as shown by the FIGURES.

Figure 15:
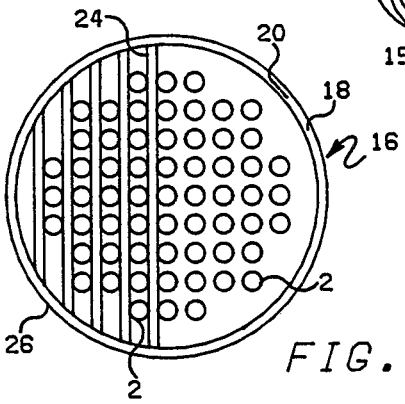
FIGS. 15 and 17 are cross-sectional views taken along the lines indicated in FIGS. 14 and 16.
Figure 17:
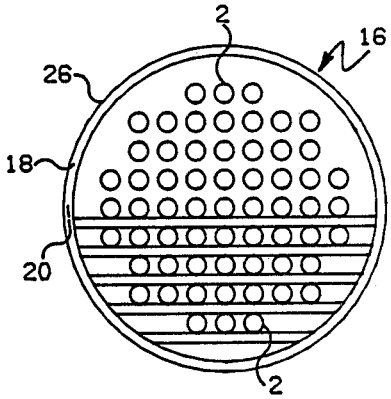
Figure 16:
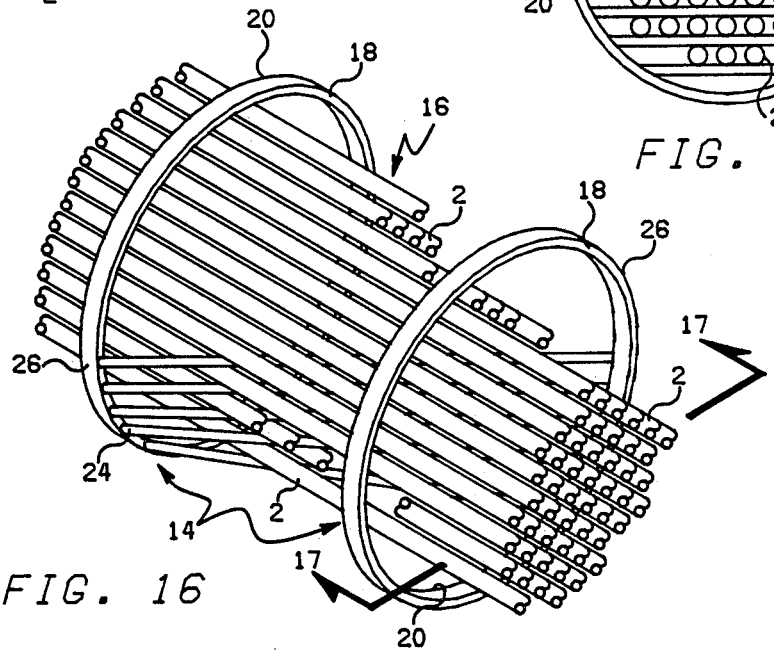

Referring now to FIGS. 14–17, the illustrated baffle set provides for a single helix flow of shell side fluid through the bundle by providing each baffle with rods extending through the tube bundle to form a segment-shaped appearing rod baffle when seen in plain view (FIGS. 15 and 17). Radial support is provided for each tube in the bundle by utilizing a rod in every available lane through the segment and a sufficient number of baffles (not shown) to provide each tube of the bundle with radial support. Here, the rods in each baffle are spaced across only about one-half of the tube bundle, in adjacent lanes of a single plurality.

Where a double helical flow pattern of rods is utilized as shown by FIGS. 9–13, it is preferred that the rods in each baffle which are spaced across first half of the tube bundle be affixed by their first ends to a first quarter of the generally annular surface presented by one end of the band and by their second ends to a first quarter of the generally annular surface presented by the other end of the band, and that the rods in each baffle which are spaced apart across the second half of the tube bundle in a portion of the lanes be affixed by their first ends to a second quarter of the first generally annular surface presented by one end of the band and a second quarter of the second generally annular surface presented by another end of the band and that the first and second quarters of each generally annular surface be spaced apart, center to center with respect to the axis of the tube bundle, by an angle of about 180°.

In the method for improving the capability of the tube bundle for mixing shell side fluid in accordance with the present invention when the tube bundle is to be employed in a shell and tube heat exchanger, the tube bundle is provided with a plurality of encircling rings or band 26 spaced apart longitudinally along the tube bundle and dividing the tube bundle into portions having a longitudinal dimension and through which there extend rods. Pluralities of rods extend transversely through each portion of the tube bundle, a plurality of rods in a portion of the bundle, with each of the rods having a first end attached to one end of the ring or band, and a second end attached to a second, different end of ring or band. Rods transversing adjacent portions of the tube bundle pass through different pluralities of parallel lanes, usually offset 90°, so that shell side fluid passes through the tube bundle in preferably longitudinally spiraling flow about the longitudinal axis of the tube bundle. Preferably, the rods extending through adjacent portions of the bundle are alternately positioned in at least a portion of the lanes between the first plurality of parallel tube rows in one portion of the bundle and at least a portion of the lanes between the second plurality parallel tube rows in the adjacent portion of the bundle. The rods in four adjacent portions of the bundle provide radial support at least once for each tube in the bundle.

That which is claimed is:

1. In a method for producing longitudinal and spiral flow of shell side fluid through a shell and tube heat exchanger of the type wherein tube side fluid is passed through a plurality of generally parallel, transversely spaced apart tubes arranged along longitudinal axes in an ordered pitch configuration, and wherein a shell side fluid is introduced into one end region of a shell positioned about said tubes, passed through said shell generally longitudinally and in heat exchange relationship to said tubes, and removed from an opposite end region of said shell, the improvement which comprises the step of:

moving such shell side fluid concurrently during such passing against a series of progressively located, relative to the direction of longitudinal shell side fluid flow, rod groups, all individual rods of each such rod group extending diagonally relative to the longitudinal axes through the spacings defined between such tubes, and being in generally parallel relationship to one another transversely across said tubes when such a rod group is viewed in a cross section taken through such rod group and said tubes, the respective rod members of each succeeding such rod group proceeding longitudinally along said tubes being disposed at an angle which is circumferentially angularly displaced relative to the respective rod members of the preceding such rod group, whereby said shell side fluid in so passing sweeps across said tubes in a generally spiral manner.

2. A method of claim 1 wherein the interrelationship between said moving fluid and said progressively located rod groups is such that said shell side fluid spirals through at least about 360° during said passing.

3. In a method of heat exchange using a shell and tube heat exchanger wherein a tube side fluid is passed through a plurality of parallel longitudinally disposed tubes and a shell side fluid is passed through a shell positioned about said tubes generally longitudinally in heat exchange relationship to said tube side fluid, the improvement comprising the steps of:

(a) diagonally extending relative to the longitudinally disposed tubes through spaces defined between said tubes a plurality of rods, (1) such rod plurality being comprised of rod groups, (2) a different rod group being successively positioned adjacent a preceding rod group longitudinally along said tubes, (3) the rod members of each such rod group being in spaced, parallel relationship to one another transversely across said tubes when said tubes are viewed in a cross section therethrough, (b) disposing the respective rod members of each succeeding such rod group proceeding longitudinally along said tubes at angle which is circumferentially displaced relative to the respective rod members of the preceding such rod group, and (c) affixing the opposite ends of each rod member to ring means circumferentially extending about said tubes within said shell, whereby said shell side fluid in a so passing sweeps across said tubes in a generally spiral manner.

4. A method for producing a longitudinally spiraling flow path for fluid flowing in the shell side of a shell and tube heat exchanger, said heat exchanger comprising a plurality of elongated tubes forming a longitudinally extending tube bundle.

tube sheet means for supporting opposite end regions of said tube bundle, shell means associated with said tube sheet means and circumscribing said tube bundle in fluid-tight relationship, and including a pair of port means each one at a different opposed end region thereof for ingress and egress of a fluid circulating longitudinally therethrough in heat exchange relationship to said tubes, and a pair of header means, each one including port means and being functionally associated in fluid tight relationship with a different opposite end region of said tube bundle for ingress and egress of a fluid circulating longitudinally through said tubes of said plurality, said tubes of said tube plurality being arranged in spaced, parallel relationship to one another in said tube bundle, and in a predetermined pitch configuration, whereby, when said tube bundle is viewed in cross section, at least two configurations of ordered, spaced, parallel rows of tube pluralities exist in said tube bundle, the rows of each such configuration being angularly displaced circumferentially about said tube bundle relative to the circumferentially adjacent rows of the next such configuration by a fixed angle, whereby a lane region is located between each pair of adjacent such rows in each such configuration, and whereby, when said tube bundle is viewed in cross section, a plurality of spaced, parallel lane regions exists for each such row configuration, thereby to provide at least two pluralities of spaced, parallel lane regions with the respective members of each such plurality of lane regions being circumferentially angularly displaced relative to the respective members of the adjacent such lane region plurality by a fixed angle, said method comprising the steps of (a) positioning ring retaining member means circumferentially around said tube bundle within said shell means, (b) extending a series of different pluralities of elongated rod members diagonally relative to the longitudinally extending tube bundle through said lane regions of said tube bundle, a first such rod member plurality of said series being in said tube bundle adjacent one end region thereof, a last such rod member plurality of said series being in said tube bundle adjacent the opposite end region thereof, and all intervening such rod member pluralities of said series being successively longitudinally located in said tube bundle therebetween, (c) placing each rod member of each such rod member plurality in a different selected one lane region of a lane region plurality, all rod members of one rod plurality being associated with a different one selected lane region plurality, and all rod members of one rod plurality being in spaced, parallel relationship to each other when said tube bundle is viewed in a cross section taken therethrough, (d) situating the individual rod members of each succeeding such rod member plurality of said series longitudinally along said tube bundle in the respective individual lane of the next angularly displaced but circumferentially adjacent lane region plurality relative to the preceding lane region plurality, and (e) securing the opposite end regions of each rod member of each such rod member plurality to said ring retaining member means, whereby the interrelationship between said extending, said placing, and said situating is such that a fluid flowing through the shell side of said heat exchanger from one said port means to the other thereof displays longitudinally spiraling flow.

5. A method of claim 4 wherein the total number of said pluralities of elongated rod members is at least sufficient to produce 360° of spiral movement of shell side fluid from an input port to an output port in said shell means.

6. The method of claim 4 wherein said tubs of said plurality are so ordered a to define lane pluralities which are each so offset from one another by a fixed angle of 90°, and at least four successive pluralities of elongated rod members are employed with each such rod plurality being in adjacent longitudinal relationship to another or other thereof, and each succeeding such rod plurality after the first rod plurality is offset at an angle of 90°relative to the preceding such rod plurality, so that shell side fluid can pass through said tube bundle in a spiraling flow turning through 360° between input and output parts of such shell means at respective opposite ends thereof.

7. The method of claim 6 wherein said respective pluralities of rod members coact to provide radial support for each tube of said tube bundle.

* * * * *